US006540443B2

(12) United States Patent
Kato et al.

(10) Patent No.: US 6,540,443 B2
(45) Date of Patent: Apr. 1, 2003

(54) APPARATUS FOR AND A METHOD OF BORING THE GROUND

(75) Inventors: Masatoshi Kato, Osaka (JP); Shigeki Ashida, Munich (DE); Daisuke Fujiki, AW Almere (NL); Leonhard Weixler, Schrobenhausen (DE)

(73) Assignees: Bauer Maschinen GmbH, Schrobenhausen (DE); Kato Kenki Yugen Kaisha, Sakai (JP)

( * ) Notice: Subject to any disclaimer, the term of this patent is extended or adjusted under 35 U.S.C. 154(b) by 0 days.

(21) Appl. No.: 09/852,219

(22) Filed: May 10, 2001

(65) Prior Publication Data

US 2001/0041099 A1 Nov. 15, 2001

(30) Foreign Application Priority Data

May 11, 2000 (JP) ..... 2000-138897

(51) Int. Cl.[7] ..... E02D 7/26

(52) U.S. Cl. ..... 405/232; 405/233; 405/249; 175/162

(58) Field of Search ..... 405/231–233, 405/249, 257; 175/113, 162, 171

(56) References Cited

U.S. PATENT DOCUMENTS 5,653,556 A * 8/1997 White ..... 405/249

FOREIGN PATENT DOCUMENTS

JP 7-310489 * 11/1995

* cited by examiner

*Primary Examiner*—David Bagnell
*Assistant Examiner*—Sunil Singh
(74) *Attorney, Agent, or Firm*—Jacobson Holman PLLC

(57) ABSTRACT

A ground-boring apparatus for boring the ground within a casing tube, which is driven into the ground by a casing tube pusher machine to prevent the surrounding soil from collapsing into a to be formed hole. The soil removed by an extensible kelly bar to be suspended by a movable crane, a boring bucket attached to the lower end of the kelly bar, a supporting frame unit to be placed on the casing tube for holding the kelly bar rotatably about its vertical axis, hydraulic motors provided on the supporting frame unit for turning the kelly bar about its vertical axis, and clamping devices for joining the supporting frame unit and the casing tube.

8 Claims, 14 Drawing Sheets

APPARATUS FOR AND A METHOD OF BORING THE GROUND

BACKGROUND OF THE INVENTION

The present invention relates to ground-boring apparatus and a ground-boring method suited for the all-casing method.

Conventionally, cast-in-place concrete pile technology has been widely used for making foundation piles at the construction site of a building, for example, in which each concrete pile is made by boring a hole in the ground, inserting a cage made of steel reinforcing bars into the hole, and pouring concrete into the hole. Various methods are known in the conventional cast-in-place concrete pile technology, including the earth drill method and all-casing method.

The earth drill method is a method of making a hole in the ground using a cylindrical rotary bucket, or using a soil stabilizer to protect the wall of the hole. This method is suited for boring relatively hard ground mainly containing clay, for example.

On the other hand, the all-casing method is a method of making a hole in the ground by driving a casing tube into the ground and digging inside the casing tube. This method allows boring even soft ground, such as reclaimed land. Since a plurality of casing tubes can be driven one on top of another, it is possible to make a long pile which will reach a deep bearing stratum. Moreover, since this method enables boring operation to be done even when there is an obstacle underground, it is frequently used in recent years.

A commonly used technique in the all-casing method for inserting a casing tube into the ground is to drive the casing tube by pressure while turning it about its vertical axis using an all-round rotary boring machine. In all-casing boring operation, it is necessary to dig the ground inside the casing tube and remove soil from the inside of the casing tube. A hammer grab has conventionally been used as a tool for doing this task.

The hammer grab, however, has a problem that its digging and soil-discharging efficiency is rather poor, because it uses a pair of claw members which is operated in a narrow space within the casing tube to dig and pick up soil. The hammer grab also has a problem that it produces a high level of noise as it is repeatedly dropped during the boring operation. Furthermore, since the hammer grab cannot level off the bottom of a hole, a cage which will serve as a core of a pile can not be set in a stable position, leading to a possibility of variations in the strength of finished concrete piles. Moreover, when slime sets at the bottom of the hole, it is necessary to remove it by using a pump, resulting in an increase in the number of processes.

Under these circumstances, a new drilling method is going to be put into practical use today, in which, instead of a hammer grab, a boring screw head is inserted into a casing tube to dig and remove soil at the same time. The boring screw head is raised and lowered along a leader which serves as a guide suspended in a vertical position from a base machine, so that boring operation is performed with the base machine held close to an all-round rotary boring machine in this drilling method. This new drilling method serves to dramatically improve the efficiency of digging and removing soil compared to the aforementioned hammer grab method.

This drilling method, however, has a problem that it can not be used for making a hole if there is an unleveled area or obstacle between the base machine and a boring point, because the base machine must be located close to the boring point where the all-round rotary boring machine is installed. Furthermore, as the distance between the base machine and the boring point can not be made so large, the diameter of the all-round rotary boring machine is limited, making it impossible to bore a hole having a large diameter as a consequence.

Since the vertically positioning accuracy of the boring screw head is affected by the horizontally positioning accuracy of the base machine, it is necessary to level off an area of the ground where the base machine is installed to achieve its highly accurate horizontal position. In addition, since the base machine is dedicated exclusively to boring operation, it is necessary to move it away and bring in an auxiliary crane as the need arises to perform hoisting operation, such as when handling a cage or inserting an additional casing tube.

SUMMARY OF THE INVENTION

The present invention has been made in view of the aforementioned problems of the conventional cast-in-place concrete pile technology. Accordingly, it is an object of the invention to provide ground-boring apparatus and a ground-boring method which make it possible to efficiently bore a hole of a desired diameter regardless of ground conditions of a boring site without the need of a dedicated boring machine and thereby reduce the number of processes required for boring operation.

According to an aspect of the invention, a ground-boring apparatus is adapted for boring the ground within a casing tube and removing soil from the bored hole. The casing tube is driven into the ground by a casing tube pusher to prevent the ground from collapsing into a bored hole. The apparatus comprises an extensible telescopic cylinder to be suspended by a movable crane, a boring tool attached to the lower end of the telescopic cylinder, a supporting frame unit to be placed on the casing tube for holding the telescopic cylinder rotatably about its vertical axis, a driver provided on the supporting frame unit for turning the telescopic cylinder about its vertical axis, and an interlock device for joining the supporting frame unit and the casing tube to thereby ensure the rotation of the telescopic cylinder counteracting a reaction force exerted by the rotating telescopic cylinder.

According to another aspect of the invention, a method of boring the ground comprises the steps of driving a casing tube into the ground by a casing tube pusher to prevent the ground from collapsing into a bored hole, placing the aforementioned ground-boring apparatus suspended by a movable crane on the casing tube, fastening the casing tube to the supporting frame unit, and digging the ground within the casing tube while rotating the telescopic cylinder about its vertical axis and extending the telescopic cylinder according to the depth of the bored hole.

These and other objects, features, aspects, and advantages of the present invention will become more apparent from the following detailed description of the preferred embodiments/examples with reference to the accompanying drawings.

BRIEF DESCRIPTION OF THE DRAWINGS

FIGS. 6A–6B are diagrams showing preparatory processes of ground-boring operation according to the embodiment, in which FIG. 6A illustrates how a casing tube pusher machine is placed and FIG. 6B illustrates how a casing tube is forced into the ground;

FIGS. 7A–7B are diagrams showing succeeding processes of the ground-boring operation, in which FIG. 7A illustrates how the ground-boring machine is set and FIG. 7B illustrates how a bucket digs the ground within the casing tube;

FIGS. 8A–8B are diagrams showing succeeding processes of the ground-boring operation, in which FIG. 8A illustrates how excavated material is discharged and FIG. 8B illustrates how the casing tube is forced deeper into the ground;

DETAILED DESCRIPTION OF THE PREFERRED EMBODIMENTS OF THE INVENTION

Figure 1:
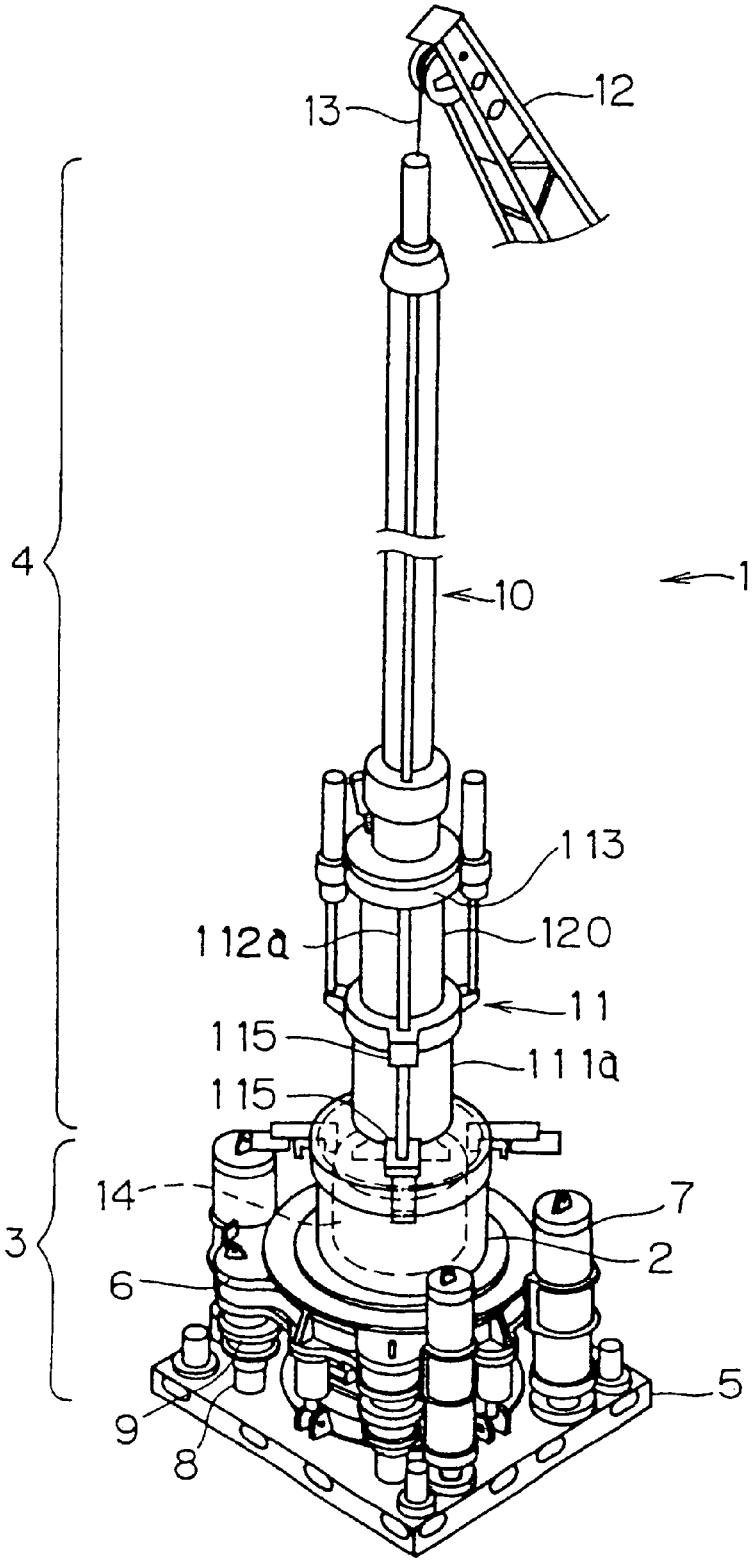
FIG. 1 is an overall perspective view of a ground-boring system according to an embodiment of the invention.

The invention will be described in detail with reference to its preferred embodiment which is illustrated in the accompanying drawings. FIG. 1 is an overall perspective view of a ground-boring system 1 according to an embodiment of the invention. The ground-boring system 1 is constructed mainly of a casing tube pusher machine 3 of the prior art for driving a casing tube 2 into the ground and a ground-boring machine 4 provided atop the casing tube 2 which is mounted in the casing tube pusher machine 3.

The casing tube pusher machine 3 forces the casing tube 2 into the ground in a vertical position while turning it all round with a high torque to thereby prevent soil from collapsing into a bored hole. The casing tube pusher machine 3 comprises a base frame 5 to be placed in a horizontal position, on which a plurality of up/down cylinders 7 for raising and lowering an up/down frame 6 are vertically mounted.

A plurality of hydraulic motors 8 are provided on the up/down frame 6 for turning the casing tube 2 about its vertical axis via planetary reduction gears 9. There is provided a weight (not shown) on the base frame 5 to fully counteract a reaction force exerted by the rotating casing tube 2 during boring operation.

The ground-boring machine 4 need not necessarily be an all-round rotation type but may be a swing-motion type.

The ground-boring machine 4 comprises an extensible kelly bar 10 of a telescopic structure having a plurality of overlapping cylindrical members and a supporting frame unit 11 which is placed immediately atop the casing tube 2 and holds a lower part of the extensible kelly bar 10. The extensible kelly bar 10 is suspended by its upper end by means of a wire rope 13 which is paid out from a movable crane 12 (hereinafter referred to simply as the crane 12).

A cylindrical boring bucket (boring tool) 14 is connected to the lower end of the innermost cylindrical member 10*c* of the extensible kelly bar 10. The boring bucket 14 drills underlying bedrock strata, for example, with a plurality of boring bits embedded in the bottom end of the boring bucket 14 and accommodates excavated material in its inner space. The construction of this boring bucket 14 is conventional.

Figure 2:
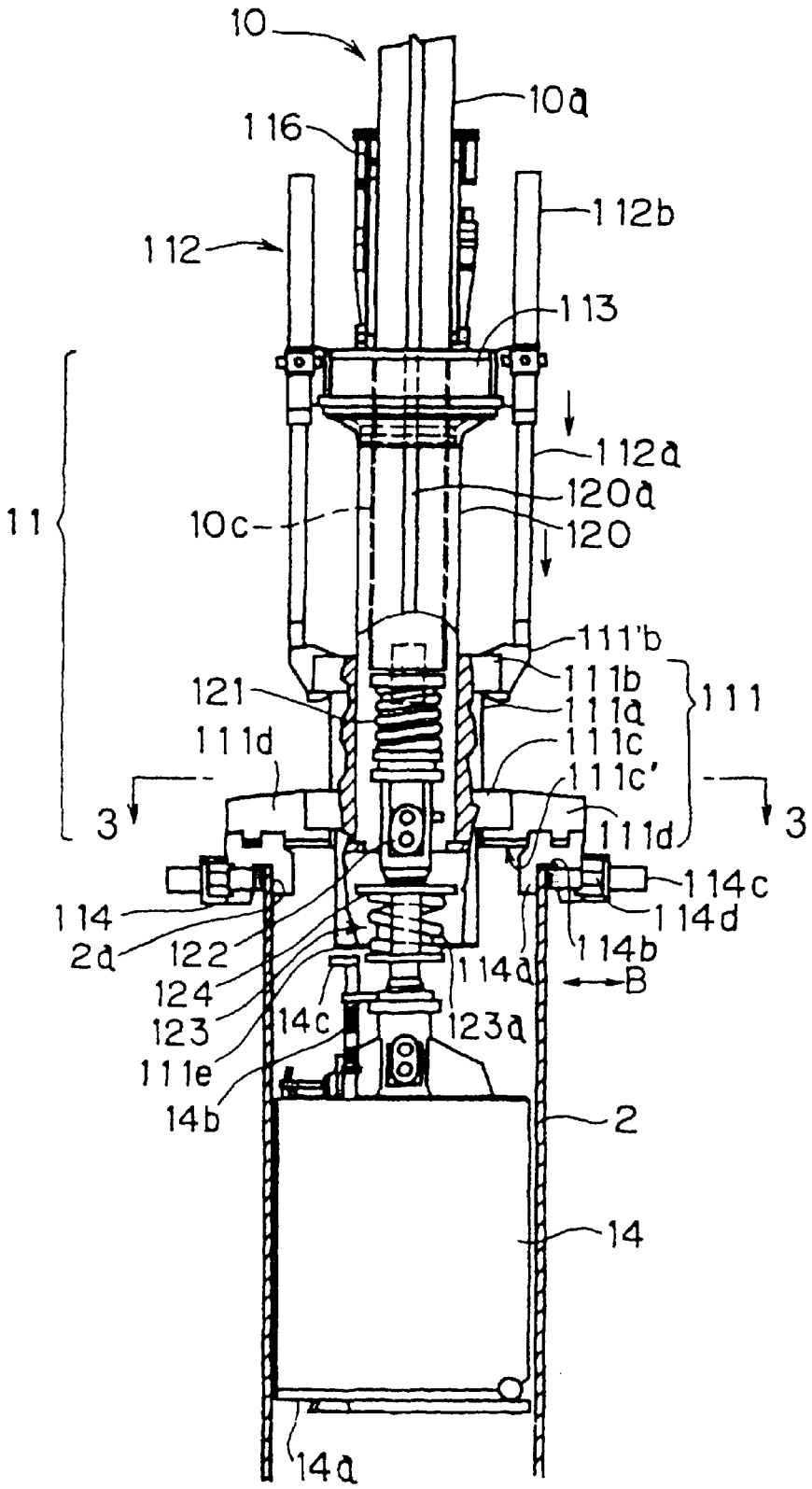
FIG. 2 is an enlarged partially cutaway view of a ground-boring machine shown in FIG. 1.

There is provided a hinged bottom plate 14*a* on the bottom of the boring bucket 14 as shown in FIG. 2, and an operating rod 14*b* for opening the bottom plate 14*a* extending downward onto its upper surface. There is provided a contact plate 14*c* at the upper end of the operating rod 14*b* as shown. When a lower end 111*e* of a later-described outer cylindrical part 111*a* comes in contact with the boring bucket 14 and pushes it downward, the operating rod 14*b* lowers and disengages a latch mechanism (not shown) which normally keeps the operating rod 14*b* in a closed position. When the latch mechanism is disengaged in this manner, the hinged bottom plate 14*a* opens by the weight of the excavated material within the boring bucket 14 and discharges the excavated material.

FIG. 2 is an enlarged partially cutaway view showing the construction of the ground-boring machine 4.

As shown in FIG. 2, the supporting frame unit 11 holding the lower part of the extensible kelly bar 10 is constructed of a stationary frame 111 placed at an upper end 2*a* of the casing tube 2 and a movable frame 113 which holds the outermost cylindrical member 10*a* of the extensible kelly bar 10, the movable frame 113 being connected to the stationary frame 111 via a pair of hydraulic cylinders 112 vertically mounted on the stationary frame 111. A later-described inner cylindrical part 120 integrally attached to the movable frame 113 extends downward therefrom as illustrated.

The stationary frame 111 includes the aforementioned outer cylindrical part 111*a* in which the inner cylindrical part 120 is inserted, the outer cylindrical part 111*a* having an upper flange portion 111*b* and a lower flange portion 111*c* radially protruding from upper and middle parts of the outer cylindrical part 111*a*, respectively. Four leg projections 111*d* extend from the lower flange portion 111*c* in a crisscross pattern in plan view. Of these leg projections 111*d*, two opposed leg projections 111*d* are individually fitted with clamping devices 114 which serve as means for acting against the reaction force exerted by the rotating casing tube 2.

Each of the clamping devices 114 includes a clamping block 114*a* which is secured to the bottom of the relevant leg projection 111*d*. The upper end 2*a* of the casing tube 2 is fitted into a U-shaped gap formed in each clamping block 114*a*.

Each of the clamping devices 114 further includes a pusher 114*b* which can move either backward or forward in the aforementioned U-shaped gap in the clamping block 114*a* in the directions of double arrow B shown in FIG. 2. The pusher 114*b* is moved back and forth by extending and retracting a rod 114*d* of a hydraulic cylinder 114*c* which is fixed to each clamping block 114*a*.

When the pushers 114*b* of the clamping devices 114 are moved forward, the clamping devices 114 firmly grip the upper end 2*a* of the casing tube 2, whereby the stationary frame 111 secures the casing tube 2. On the contrary, when the pushers 114*b* are moved backward, the clamping devices 114 release the upper end 2*a* of the casing tube 2, and the casing tube 2 is disengaged from the stationary frame 111.

The clamping devices 114 are made movable back and forth in the directions of the double arrow B along respective guide rails 111*c*' formed on the bottom of the leg projections 111*d* radially extending from the lower flange portion 111*c* of the stationary frame 111. This allows the clamping devices 114 to be properly positioned according to the diameter of the casing tube 2.

Figure 3:
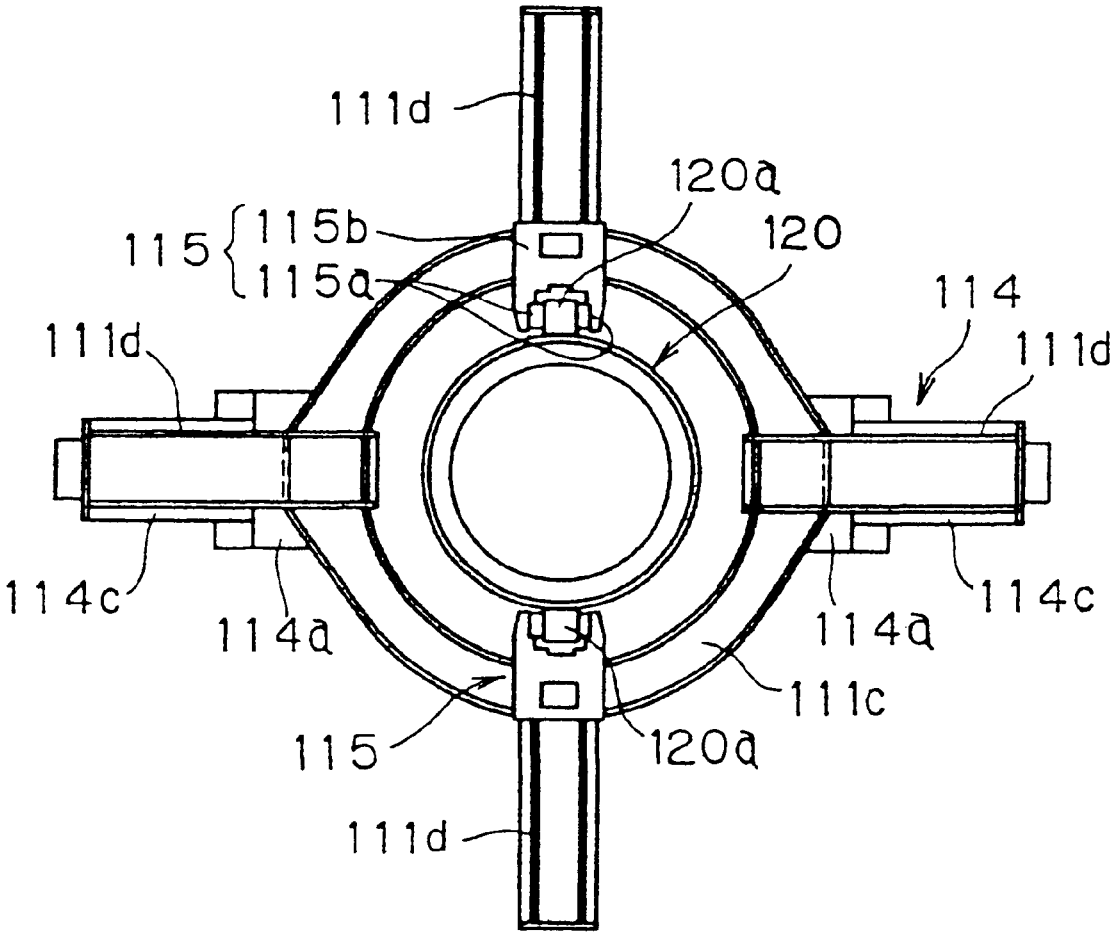
FIG. 3 is a cross-sectional view taken along lines 3—3 of FIG. 2.

FIG. 3 is a cross-sectional view taken along lines A—A of FIG. 2. Referring to FIG. 3, a pair of kelly bar guides 115 are formed extending in opposite directions from the lower flange portion 111*c* of the outer cylindrical part 111*a* at right angles to a line connecting the two clamping devices 114.

Similar kelly bar guides 115 are formed on the upper flange portion 111*b* of the outer cylindrical part 111*a* as can be seen from FIG. 1. The kelly bar guides 115 on the upper flange portion 111*b* and the lower flange portion 111*c* engage ridge projections 120*a* formed on the cylindrical part 120 parallel to its axial direction to guide the inner cylindrical part 120 as it moves upward and downward.

More specifically, each of the kelly bar guides 115 includes a pair of rollers 115*a* for holding the relevant ridge projection 120*a* from both sides and a metallic support 115*b* rotatably supporting the rollers 115*a*.

Figure 4:
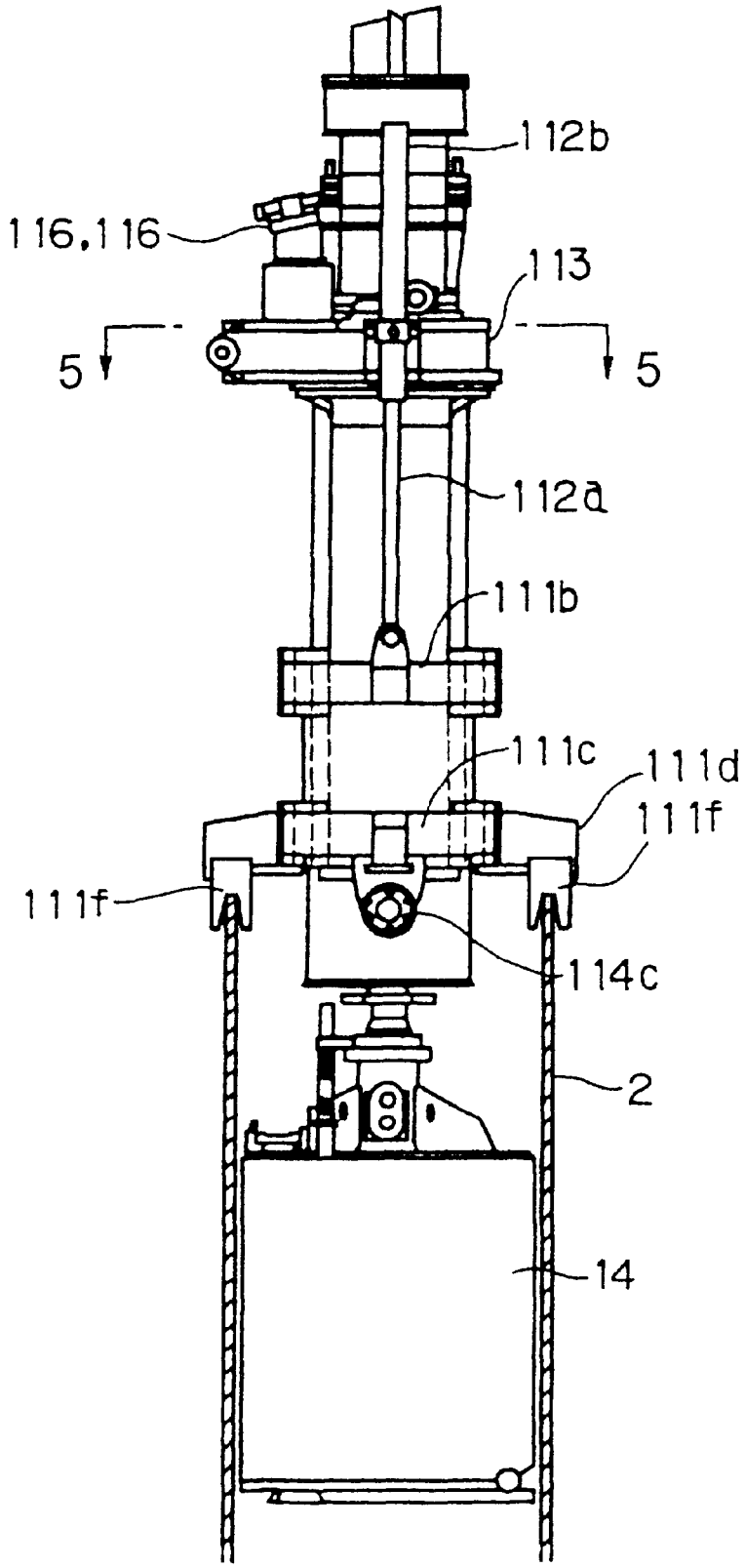
FIG. 4 is a left side view of the ground-boring machine shown in FIG. 2.

A pair of metallic fixtures 111*f* each having a V-shaped groove which can fit onto the upper end 2*a* of the casing tube 2 are provided on the bottom of two leg projections 111*d* as shown in FIG. 4. Referring again to FIG. 2, a pair of brackets 111*b*' extending to the left and right as illustrated are formed on the upper flange portion 111*b*, and rods 112*a* extending downward from the earlier-mentioned hydraulic cylinders 112 are connected to the brackets 111*b*'. Tubes 112*b* of the hydraulic cylinders 112 are individually fixed to the movable frame 113.

Figure 5:
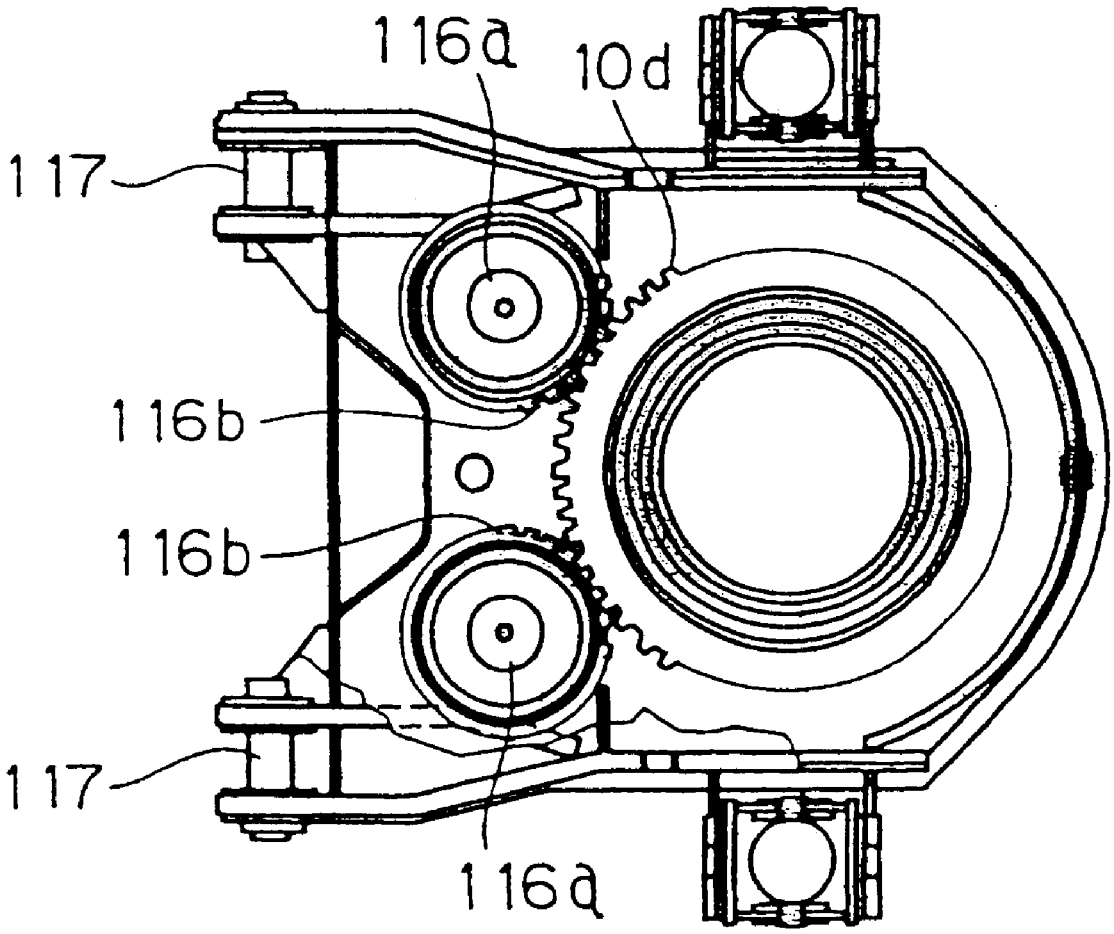
FIG. 5 is a cross-sectional view taken along lines 5—5 of FIG. 4.

A pair of hydraulic motors 116 are installed on the movable frame 113 as shown in FIG. 4. Referring to FIG. 5 showing a cross-sectional view taken along lines C—C of FIG. 4, driving gears 116*b* fixed to output shafts 116*a* of the individual hydraulic motors 116 mesh with an annular gear 10*d* which is fixed to the outermost cylindrical member 10*a* of the extensible kelly bar 10, so that the kelly bar 10 can be turned about its vertical axis. In FIG. 5, the numeral 117 indicates pins to which hooks are connected when transporting the ground-boring system 1.

Referring again to FIG. 2, the extensible kelly bar 10 has a triple telescopic structure in which an intermediate cylindrical member (not shown) and the aforementioned innermost cylindrical member 10*c* are successively extended from the inside of the outermost cylindrical member 10*a* as the wire rope 13 is paid out from the crane 12. The boring bucket 14 is connected to the lower end of the innermost cylindrical member 10*c* as stated earlier.

A coil spring 121, a universal joint 122 and a damper mechanism 123 are provided between the lower end of the innermost cylindrical member 10*c* and the boring bucket 14, in which the provision of the coil spring 121 is conventional.

The coil spring 121 absorbs shocks exerted on the boring bucket 14 inside the casing tube 2 during boring operation such that excessive impact load will not be transmitted to motive power sources such as the hydraulic motors 116. The universal joint 122 is provided to allow swinging of the boring bucket 14 to thereby ensure smooth boring operation.

The provision of the damper mechanism 123 is a unique feature of the present embodiment. It absorbs shocks which may occur when the extensible kelly bar 10 is fully contracted as the innermost cylindrical member 10*c* is retracted into the intermediate cylindrical member and the outermost cylindrical member 10*a* to prevent damage to the system 1.

Since the innermost cylindrical member 10*c* of the extensible kelly bar 10 slides up and down inside the casing tube 2, it is impossible to visually observe the exact timing of retraction of the innermost cylindrical member 10*c*. Retraction of the kelly bar 10 is completed with shocks when the innermost cylindrical member 10*c* is fully accommodated into the intermediate cylindrical member and the outermost cylindrical member 10*a*.

What is characteristic of the present embodiment is that the damper mechanism 123 includes a compression coil spring 123*a* attached to a stopper plate 124 which collides with the stationary frame 111 when the innermost cylindrical member 10*c* is fully accommodated into the intermediate cylindrical member and the outermost cylindrical member 10*a*, such that the compression coil spring 123*a* absorbs shocks occurring at the end of retraction of the innermost cylindrical member 10*c*.

Now, successive processes of the boring operation performed by the ground-boring system 1 of the aforementioned construction are described referring to FIGS. 6–13.

Figure 6B:
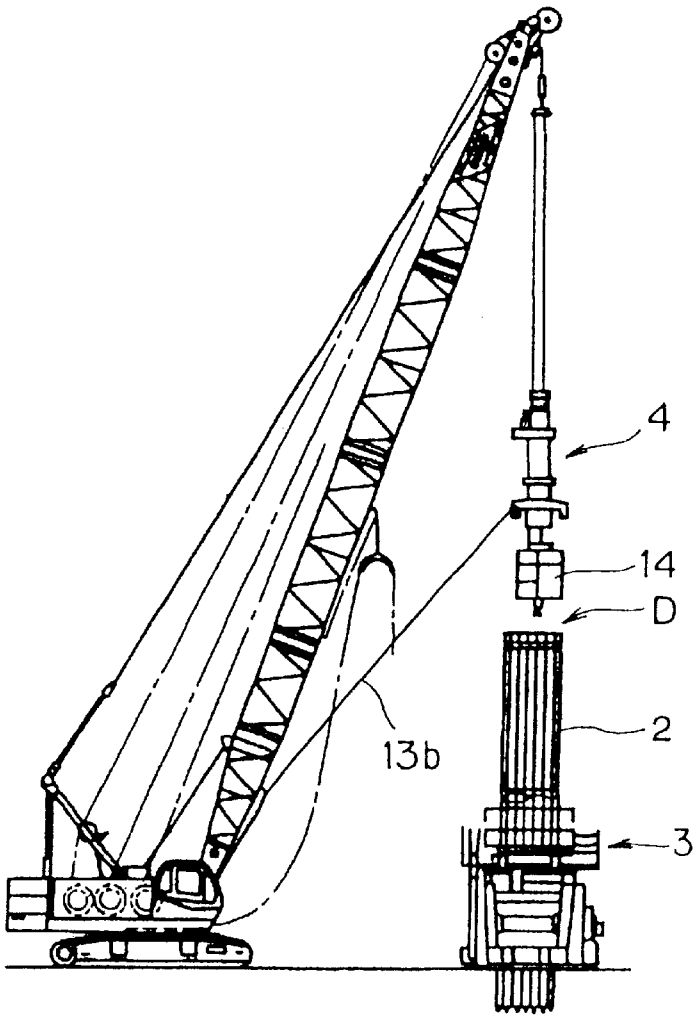
Figure 6A:
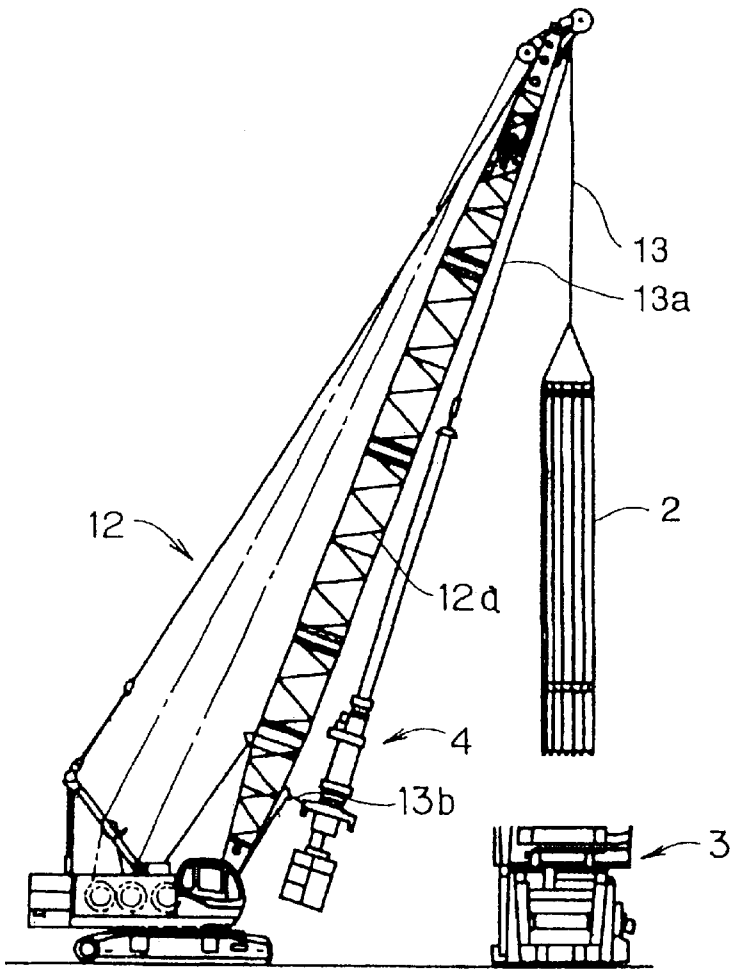

Referring first to FIG. 6A, the casing tube pusher machine 3 is placed at a boring point and the wire rope 13 is paid out from the crane 12 to descend the casing tube 2 into the casing tube pusher machine 3. At this point, the ground-boring machine 4 suspended by an auxiliary wire rope 13*a* is kept close to and along a boom 12*a* of the crane 12 by winding up a pulling wire rope 13*b* with a winch, such that the crane 12 can be used for ordinary hoisting operation.

When preparatory work has been completed with the casing tube 2 fitted to the casing tube pusher machine 3, the casing tube 2 is forced into the ground as shown in FIG. 6B. When the casing tube 2 has been driven into the ground down to a specific depth determined by ground conditions, the pulling wire rope 13*b* is loosened while winding up the auxiliary wire rope 13*a*, so that the ground-boring machine 4 is positioned above an upper opening D of the casing tube 2 as illustrated.

Figure 7B:
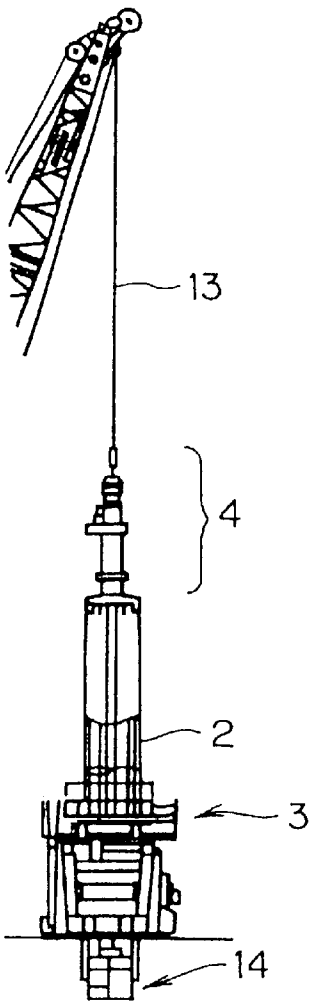
Figure 7A:
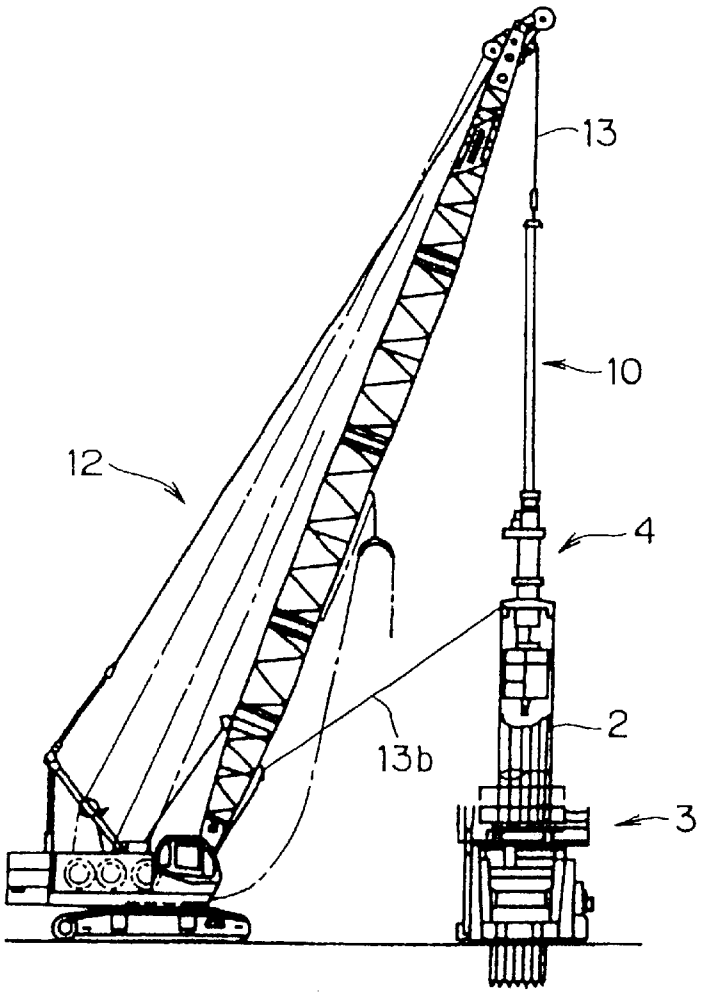

Next, the ground-boring machine 4 is positioned at the upper end of the casing tube 2 and fixed to the casing tube 2 by the clamping devices 114 as shown in FIG. 7A. The boring bucket 14 is set in motion by activating the hydraulic motors 116 of the ground-boring machine 4. The wire rope 13 is loosened to lower the boring bucket 14 as shown in FIG. 7B and the hydraulic motors 116 drive the boring bucket 14 to dig the ground within the casing tube 2.

Figure 8A:
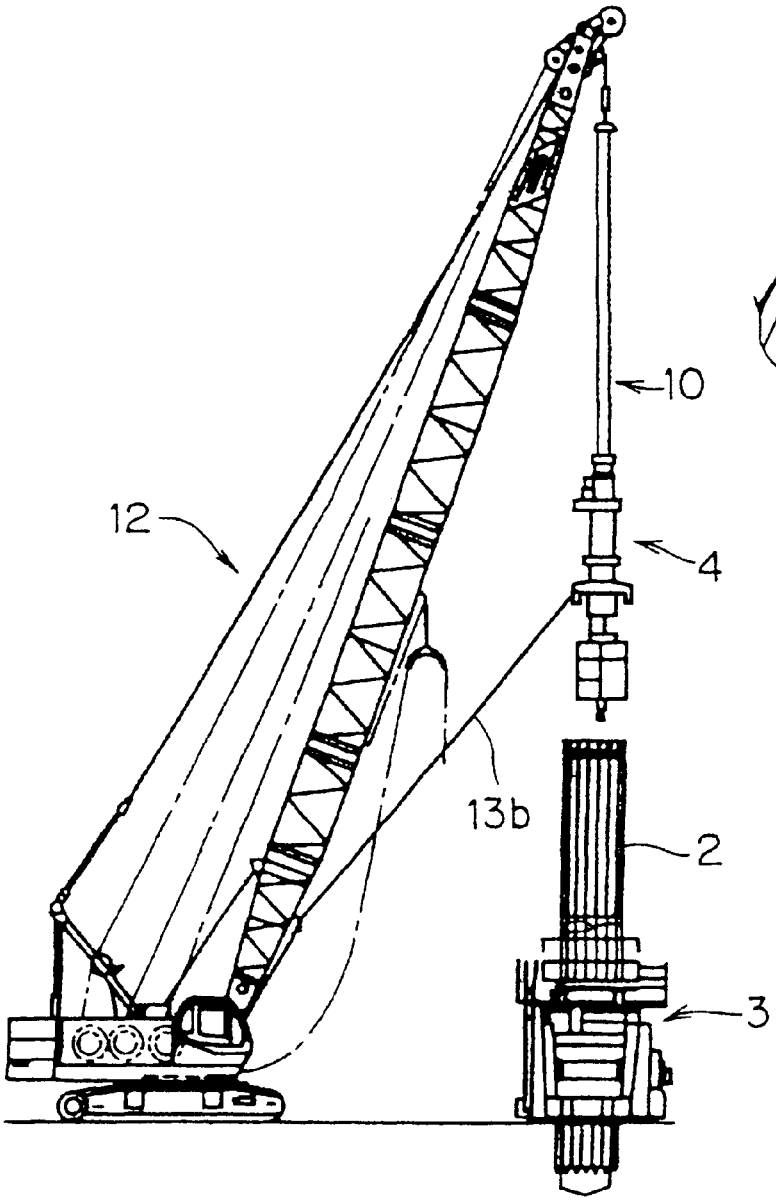

Next, the ground-boring machine 4 is hauled up as shown in FIG. 8A and its hinged bottom plate 14*a* is opened to discharge excavated material from the inside of the boring bucket 14. The pulling wire rope 13*b* serves to prevent the ground-boring machine 4 from swinging by centrifugal force when the boring bucket 14 is rotated for discharging the excavated material.

Figure 8B:
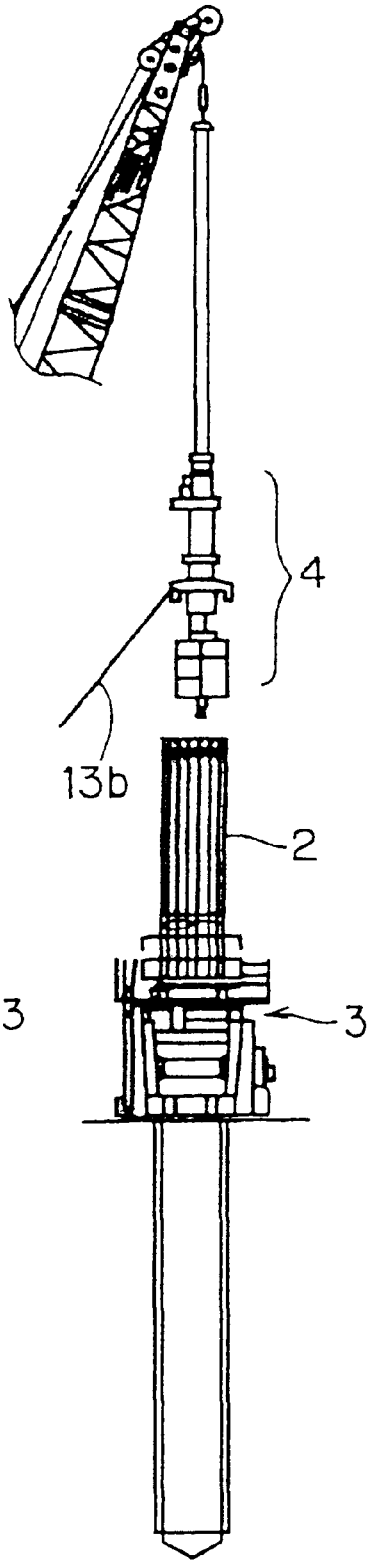
Figure 9:
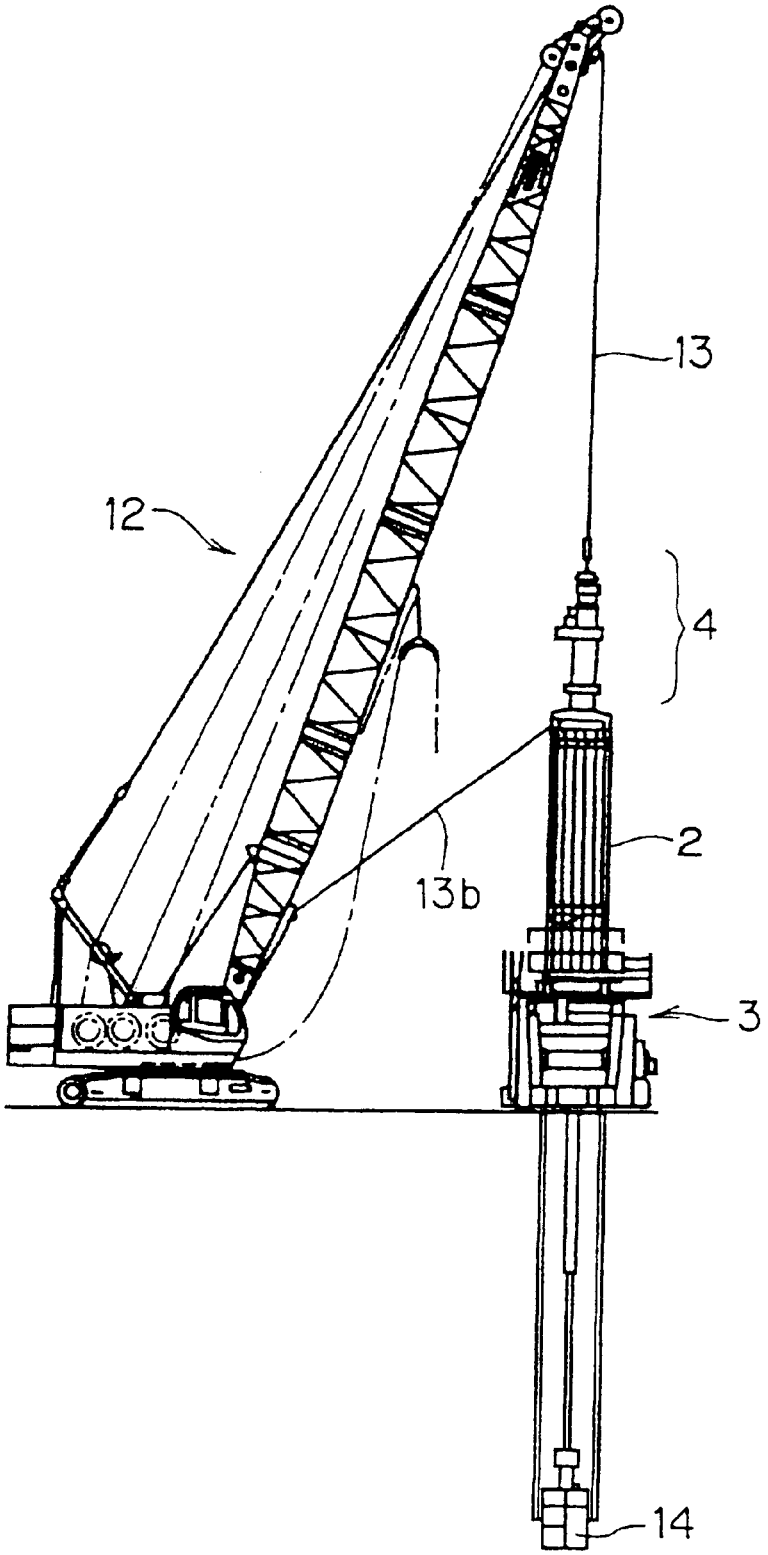
FIG. 9 is a diagram showing how the ground is dug within the casing tube.

The casing tube 2 is forced successively deeper into the ground by repeating digging and soil-discharging operations as shown in FIGS. 8B and 9. The ground-boring system 1 bores the ground by alternately driving the casing tube 2 into the ground and digging the ground within the casing tube 2 as described above. Since different motive power sources are used for performing the aforementioned casing tube driving and digging operations as shown in the foregoing discussion, work load is not concentrated on the casing tube pusher machine 3 or on the ground-boring machine 4.

Thus, neither the casing tube pusher machine 3 nor the ground-boring machine 4 is subjected to overload operating conditions, and slippage of clamping parts of the clamping devices 114 is avoided. Furthermore, the casing tube pusher machine 3 and the ground-boring machine 4 will not cause component breakage or other problems which could occur in boring operation. It is therefore possible to continuously perform the boring operation in a much stable fashion compared to the conventional all-casing method. Moreover, it is not necessary to increase the physical size of the ground-boring machine 4 for increasing its bucket-turning torque, so that the invention is applicable also to conventional all-round rotation type ground-boring machines.

Figure 10:
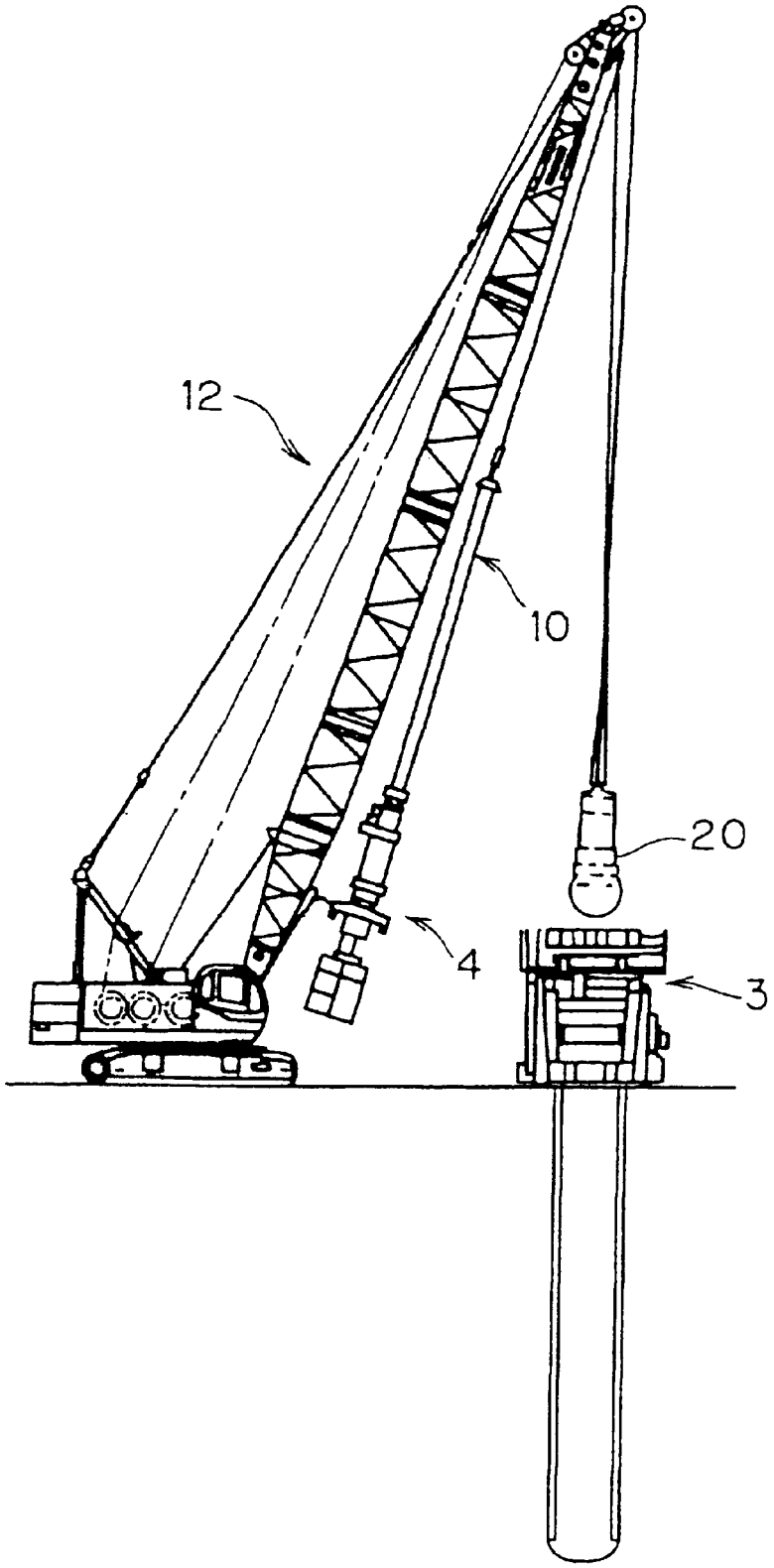
FIG. 10 is a diagram showing an example in which a hammer grab is used with the ground-boring system of the embodiment.

FIG. 10 is a diagram showing an example in which a hammer grab 20 is used with the ground-boring system 1 of the embodiment due to soil properties at the boring point. Since the present embodiment employs the ordinary crane 12 rather than a dedicated ground-boring machine, the hammer grab 20 may be used to dig a hole and remove excavated material when boring a clayey layer with the ground-boring machine 4 pulled away from the boring point. Thus, the ground-boring system 1 allows the use of the hammer grab 20 or a bedrock-breaking chisel.

Figure 11:
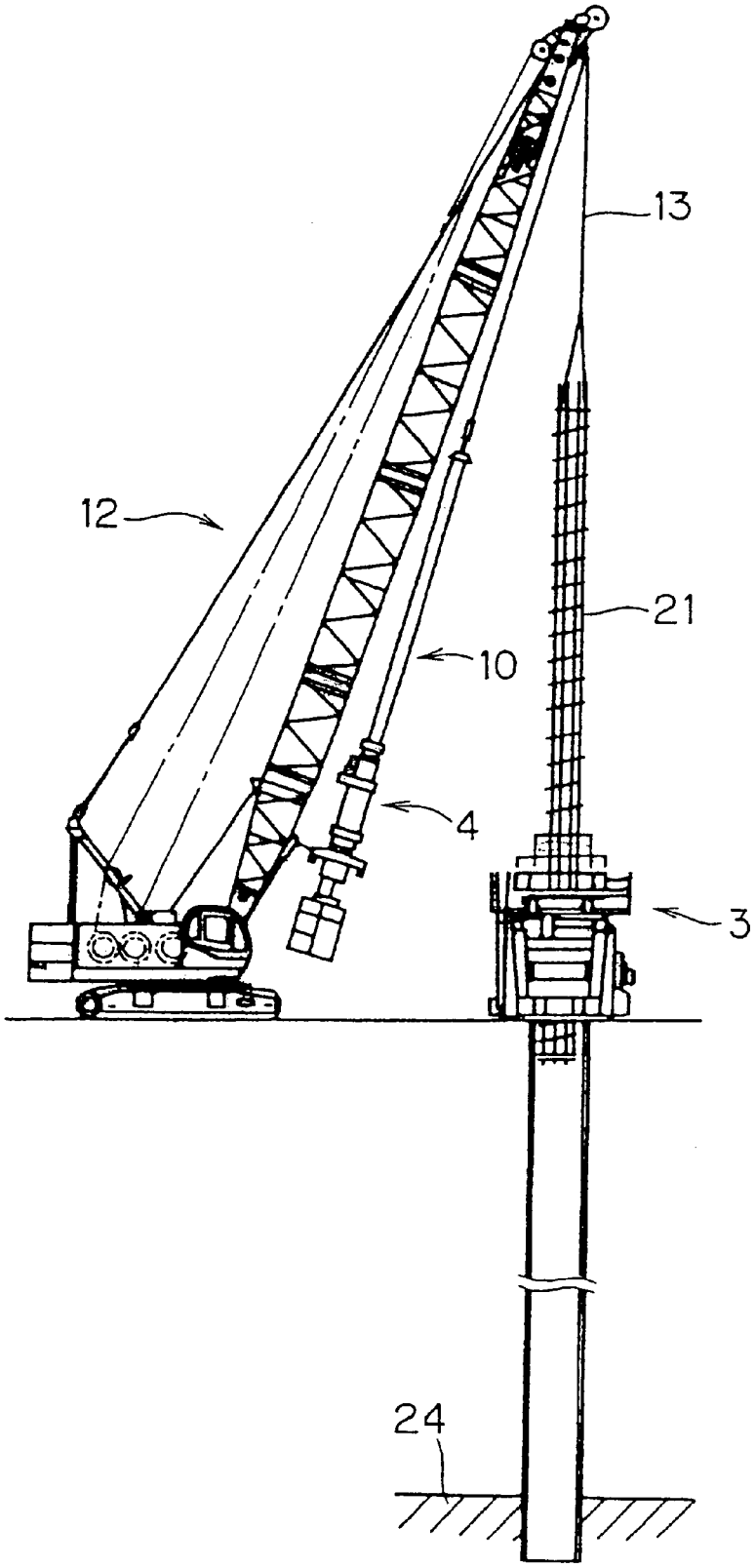
FIG. 11 is a diagram showing how a cage is inserted into a bored hole.

When the hole formed by the aforementioned processes reaches a specific depth, a cage 21 made of steel reinforcing bars is inserted into the hole as shown in FIG. 11.

Figure 12:
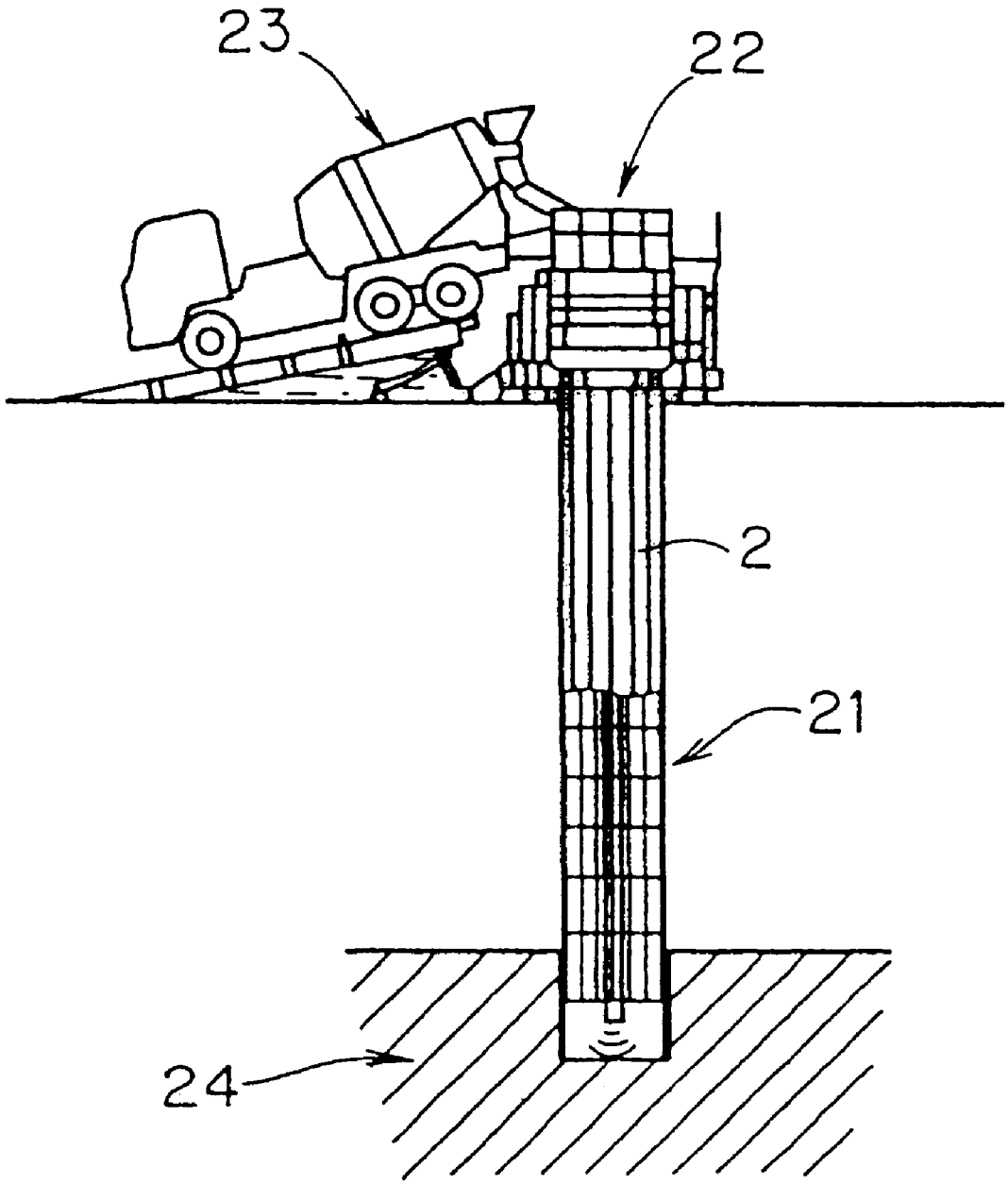
FIG. 12 is a diagram showing how concrete is poured into the bored hole.

Next, a tremie pipe 22 is set as shown in FIG. 12 and concrete is poured into the bored hole from a concrete mixer truck 23. In FIG. 12, the numeral 24 indicates an underground bearing stratum.

Figure 13:
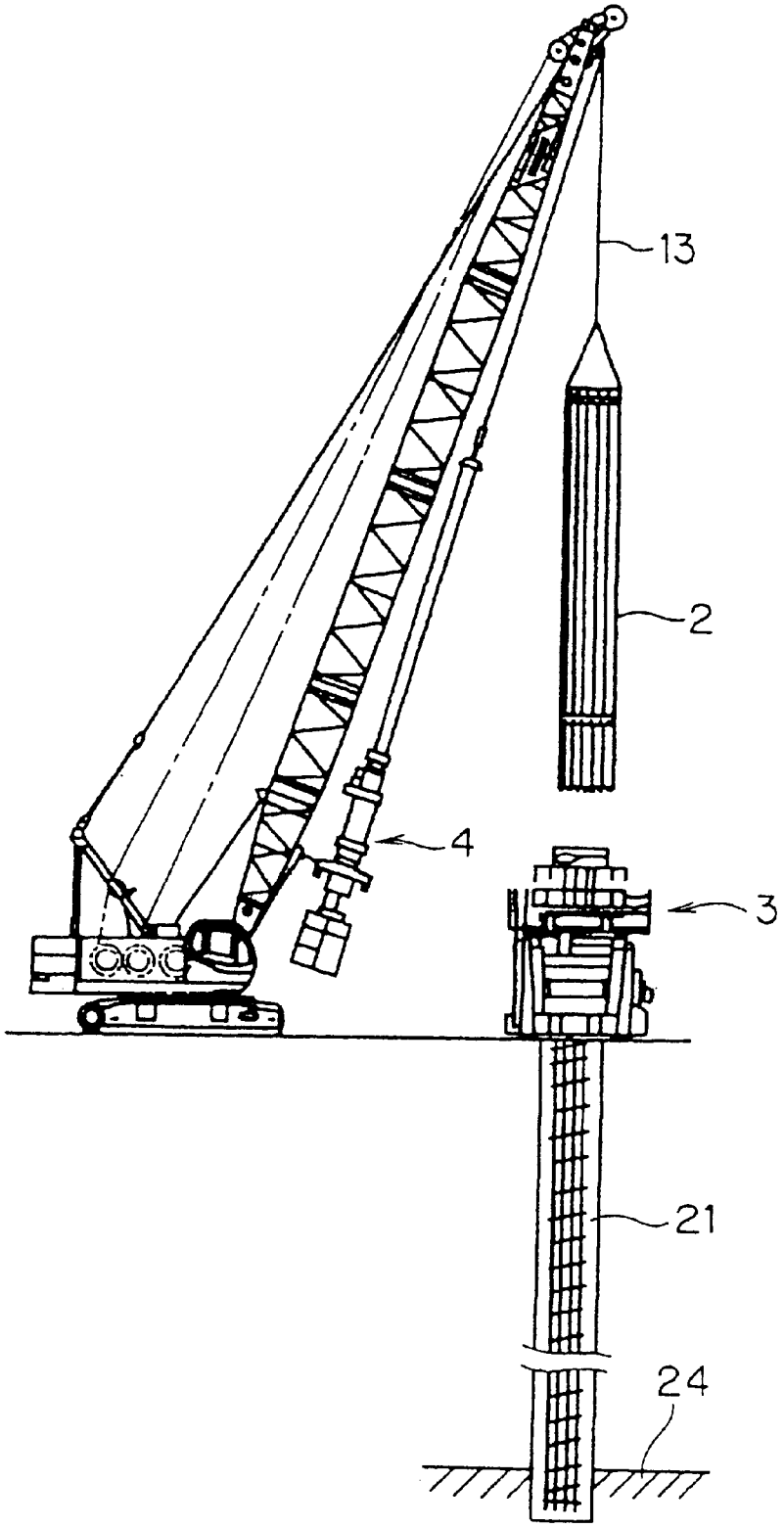
FIG. 13 is a diagram showing how the casing tube and a tremie pipe are removed.

Finally, the casing tube 2 and the tremie pipe 22 are removed as shown in FIG. 13, whereby a concrete pile is completed.

Although the boring bucket 14 is used as a boring tool in the foregoing embodiment of the invention, it is possible to use other types of boring tools which are available for making a hole in the ground or for penetrating underground structures. More specifically, it is possible to use such boring tool as a core barrel or a drilling bucket having boring bits embedded in a peripheral end portion of a cylindrical body, such boring tool as a cutter bit or a round bit having cutting media set in a terminal end of a drill, or a boring tool having a widening bit for increasing the diameter of the bottom of a bored hole in a bell-shaped form.

In the ground-boring machine 4 provided with these kinds of boring tool, the boring tool can be moved by winding and unwinding the wire rope 13 of the crane 12 with the ground-boring machine 4 fixed to the upper end 2*a* of the casing tube 2 so that the boring tool is maintained in a vertical position. It is therefore possible to raise and lower the boring tool at higher speeds inside the casing tube 2. This feature helps increase the efficiency of boring operation compared to leader-type ground-boring machines. Another advantageous feature of the ground-boring machine 4 of the embodiment is the ease of installation. Should the ground-boring machine 4 be operated together with the aforementioned boring tools and combined with the all-casing method, it is possible to achieve a high efficiency in carrying out the boring operation.

While hydraulic power for operating the hydraulic motors (driver) is supplied from an upper rotating part of the crane 12 in the foregoing embodiment, it may be taken from the casing tube pusher machine 3 according to the invention. Alternatively, there may be provided a separate hydraulic power source for driving the hydraulic motors.

Figure 14:
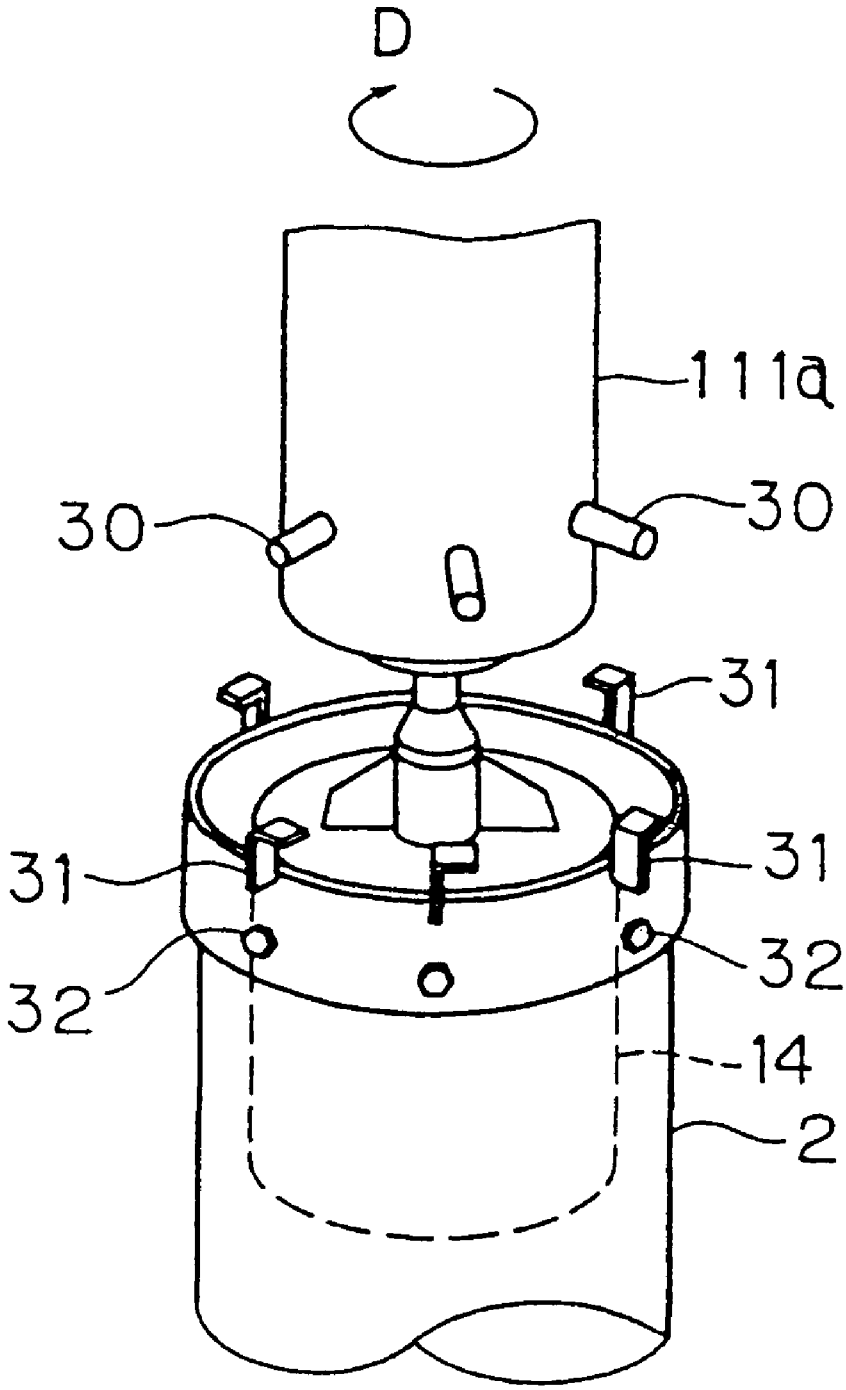
FIG. 14 is a perspective diagram showing means for counteracting a reaction force according to a modification of the embodiment.

While the means for counteracting the reaction force exerted by the rotating casing tube 2 is constructed of the clamping devices 114 in the foregoing embodiment, the invention is not limited to this construction. For example, an interlock mechanism as shown in FIG. 14 may be used as counteracting means. The reaction force counteracting mechanism of FIG. 14 includes a plurality of arms 30 radially projecting from the outer cylindrical part 111*a* of the stationary frame 111 in which the kelly bar 10 is inserted and a plurality of arm-locking parts 31 fitted to the upper end of the casing tube 2 at positions corresponding to the arms 30, such that the arms 30 engaged with the arm-locking parts 31 act against a reaction force exerted by the boring bucket 14.

The arm-locking parts 31 are generally inverted-L-shaped hook metal parts which are fixed to the outer surface of a ring secured to the upper end of the casing tube 2 by bolts 32.

The casing tube 2 can be fixed to the ground-boring machine 4 by lowering the outer cylindrical part 111*a* and slightly turning it in the direction of arrow D shown in FIG. 14. It would be understood from the foregoing that the reaction force counteracting mechanism for acting against the reaction force exerted by the boring bucket 14 can be made with an extremely simple construction. In addition, unlike the clamping devices 114, this construction does not require any motive power source or hydraulic cylinders, allowing for a reduction in costs.

While the ground-boring machine 4 of the embodiment is preferably used in the all-casing method described above, the invention is not limited thereto. The invention is applicable to the earth drill method or reverse circulation drill method, for example.

The reverse circulation drill method is a method of making a cast-in-place concrete pile, in which a rotary bit is used for boring the ground while protecting the wall of a bored hole with the static pressure of water poured into the bored hole and excavated material is discharged together with return flow of circulating water. In this method, it is possible to bore a hole with the ground-boring machine 4 fixed to the upper end of a standpipe driven into the ground.

When the invention is applied to the earth drill method, on the other hand, it is possible to bore the ground with the ground-boring machine 4 fixed to the upper end of a surface casing erected underground.

Preferably, a capping member be fitted to the upper end of the casing tube 2 to prevent its deformation potentially caused when the clamping devices 114 are tightened. Although it is necessary to remove the capping member when joining multiple casing tubes, it can be easily removed without the need of working at height.

As described above, an inventive ground-boring apparatus for boring the ground within a casing tube, which is driven into the ground by a casing tube pusher to prevent surrounding soil from collapsing into a to be formed hole, and for removing soil from the inside of the to be formed hole, comprises an extensible telescopic cylinder to be suspended by a movable crane, a boring tool attached to the lower end of the telescopic cylinder, a supporting frame unit to be placed on the casing tube for holding the telescopic cylinder rotatably about its vertical axis, a driver provided on the supporting frame unit for turning the telescopic cylinder about its vertical axis, and an interlock device for joining the supporting frame unit and the casing tube to thereby ensure the rotation of the telescopic cylinder and for the interlock device to counteract a reaction force exerted by the rotating telescopic cylinder.

The above ground-boring apparatus can be placed on the casing tube by suspending the ground-boring apparatus with a movable crane. The boring tool attached to the lower end of the telescopic cylinder is turned about its vertical axis by the driver provided on the supporting frame unit, and the casing tube is used to act against the reaction force exerted by the rotating telescopic cylinder via the interlock device during boring operation. This construction makes it possible to perform the boring operation without the need of a dedicated ground-boring machine. In addition, the ground-boring apparatus of the invention makes it possible efficiently bore a hole of a desired diameter regardless of ground conditions of a boring site.

In addition, the ground-boring apparatus suspended by the movable crane can be pulled toward a boom foot by winding up a pulling wire rope, for example, and in this condition, the movable crane can be used to perform such hoisting operation as placing the casing tube into a casing tube pusher machine, or inserting a steel cage into the bored hole. This serves to increase the rate of operation of the crane.

The boring tool of the ground-boring apparatus may include a boring bucket. This construction makes it possible to efficiently remove the soil from the inside of the casing tube.

The supporting frame unit may include a stationary frame to be placed on the upper end of the casing tube, a movable frame for holding an outermost cylindrical member of the telescopic cylinder, and a hydraulic cylinder vertically extending from the stationary frame to connect the movable frame to the stationary frame.

In this construction, the telescopic cylinder held by the movable frame can be raised and lowered by extending and contracting a rod of the hydraulic cylinder. Therefore, when setting up the ground-boring apparatus by hoisting the telescopic cylinder and moving it to a point above the casing tube using a crane, for example, the ground-boring apparatus already held above the casing tube can be placed down on the casing tube by just extending the rod of the hydraulic cylinder without the need to unwind a wire rope. In addition, once the ground-boring apparatus has been placed on the casing tube and fixed in position, the boring tool can be separated from the ground in a more reliable and safer fashion by contracting the rod of the hydraulic cylinder than lifting the boring tool by winding up the wire rope.

The interlock device may include a hydraulic clamp for locking the casing tube by clamping its upper end, the hydraulic clamp being movable in a radial direction of the casing tube.

Since the hydraulic clamp of the interlock device securely holds the upper end of the casing tube and the casing tube is used to act against a reaction force exerted by the rotating boring tool in this construction, it is possible to increase the torque, or turning force, of the boring tool and the casing tube can be easily fixed to and released from the ground-boring apparatus. Furthermore, since the hydraulic clamp can be moved in the radial direction of the casing tube, the ground-boring apparatus of the present invention is applicable to casing tubes having different diameters.

The telescopic cylinder may be provided with a shock absorber for damping shocks occurring when the telescopic cylinder is fully contracted.

Since an innermost cylindrical member of the telescopic cylinder is accommodated inside the casing tube when the telescopic cylinder is contracted, it is impossible to visually observe the exact timing of retraction of the innermost cylindrical member. Thus, retraction of the telescopic cylinder is completed with shocks when the innermost cylindrical member is fully accommodated into the outermost cylindrical member. With the provision of the shock absorber for alleviating the shocks occurring when the telescopic cylinder is fully contracted, the telescopic cylinder can be contracted without damages.

An inventive method of boring the ground, comprises the steps of driving a casing tube into the ground by a casing tube pusher to prevent the ground from collapsing into a bored hole, placing the aforementioned ground-boring apparatus suspended by a movable crane on the casing tube, fastening the casing tube to the supporting frame unit, and digging the ground within the casing tube while rotating the telescopic cylinder about its vertical axis and extending the telescopic cylinder according to the depth of the bored hole.

According to this method, it is possible to use the casing tube to counteract the reaction force exerted by the rotating boring tool when the supporting frame unit of the ground-boring apparatus is fixed to the upper end of the casing tube after driving the casing tube into the ground by the casing tube pusher to prevent the ground from collapsing into the bored hole and placing the ground-boring apparatus on the casing tube. Thus, when the telescopic cylinder is extended while rotating it about its vertical axis by the driver, it is possible to dig the ground within the casing tube.

While the movable frame to be used in the invention may be preferably a crawler crane having a self-propelled chassis and a rotatable upper body on which a tiltable boom is mounted or a wheeled crane or tower crane having an extensible boom, the invention is not limited thereto. For example, the movable frame may be a locomotive crane which runs on a railroad.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A ground-boring apparatus for boring the ground within a casing tube, which is driven into the ground by a casing tube pusher to prevent surrounding soil from collapsing into a to be formed hole, and for removing soil from the inside of the to be formed hole, the ground-boring apparatus comprising:

an extensible telescopic cylinder to be suspended by movable crane;

a boring tool attached to a lower end of the telescopic cylinder;

a supporting frame unit to be placed on the casing tube for holding the telescopic cylinder rotatably about its vertical axis;

a driver provided on the supporting frame unit for turning the telescopic cylinder about its vertical axis; and an interlock device for joining the supporting frame unit and the casing tube to thereby ensure the rotation of the telescopic cylinder and for counteracting a reaction force exerted by the rotating telescopic cylinder, the interlock device including a hydraulic clamp for locking the casing tube by clamping its upper end, the hydraulic clamp being movable in a radial direction of the casing tube.

2. The ground-boring apparatus according to claim 1, wherein the boring tool includes a boring bucket.

3. The ground-boring apparatus according to claim 2, wherein the telescopic cylinder is provided with a shock absorber for damping shocks occurring when the telescopic cylinder is fully contracted.

4. The ground-boring apparatus according to claim 2, wherein the supporting frame unit includes a stationary frame to be placed on the upper end of the casing tube, a movable frame for holding an outermost cylindrical member of the telescopic cylinder, and a hydraulic cylinder vertically extending from the stationary frame to connect the movable frame to the stationary frame.

5. The ground-boring apparatus according to claim 4, wherein the telescopic cylinder is provided with a shock absorber for damping shocks occurring when the telescopic cylinder is fully contracted.

6. The ground-boring apparatus according to claim 1, wherein the supporting frame unit includes a stationary frame to be placed on the upper end of the casing tube, a movable frame for holding an outermost cylindrical member of the telescopic cylinder, and a hydraulic cylinder vertically extending from the stationary frame to connect the movable frame to the stationary frame.

7. The ground-boring apparatus according to claim 1, wherein the telescopic cylinder is provided with a shock absorber for damping shocks occurring when the telescopic cylinder is fully contracted.

8. A method of boring the ground comprising the steps of:

driving a casing tube into the ground by a casing tube pusher to prevent the surrounding soil from collapsing into a to be formed hole;

placing a ground-boring apparatus suspended by a movable crane on the casing tube, the ground-boring apparatus being provided with:

an extensible telescopic cylinder to be suspended by the movable crane;

a boring tool attached to the lower end of the telescopic cylinder;

a supporting frame unit to be placed on the casing tube for holding the telescopic cylinder rotatably about its vertical axis;

a driver provided on the supporting frame unit for turning the telescopic cylinder about its vertical axis; and an interlock device for joining the supporting frame unit and the casing tube to thereby ensure the rotation of the telescopic cylinder and for counteracting a reaction force exerted by the rotating telescopic cylinder, the interlock device including a hydraulic clamp for locking the casing tube by clamping its upper end, the hydraulic clamp being movable in a radial direction of the casing tube;

fastening the casing tube to the supporting frame unit; and digging the ground within the casing tube while rotating the telescopic cylinder about its vertical axis and extending the telescopic cylinder according to the depth of the bored hole.

* * * * *